US011114766B1

(12) United States Patent
Hyman

(10) Patent No.: US 11,114,766 B1
(45) Date of Patent: Sep. 7, 2021

(54) TAPERED SLOT ANTENNA

(71) Applicant: IXI Technology Holdings, Inc., Yorba Linda, CA (US)

(72) Inventor: Daniel Hyman, Long Beach, CA (US)

(73) Assignee: IXI Technology Holdings, Inc., Yorba Linda, CA (US)

( * ) Notice: Subject to any disclaimer, the term of this patent is extended or adjusted under 35 U.S.C. 154(b) by 0 days.

(21) Appl. No.: 16/810,778

(22) Filed: Mar. 5, 2020

(51) Int. Cl.
*H01Q 13/08* (2006.01)

(52) U.S. Cl.
CPC ..... *H01Q 13/085* (2013.01)

(58) Field of Classification Search
CPC ..... H01Q 13/08–13/18; H01Q 21/064
See application file for complete search history.

(56) References Cited

U.S. PATENT DOCUMENTS 5,036,335 A * 7/1991 Jairam ..... H01Q 13/106 343/767
5,081,466 A * 1/1992 Bitter, Jr. ..... H01Q 13/085 343/767
5,748,153 A * 5/1998 McKinzie, III ..... H01Q 13/08 343/767
7,064,722 B1 6/2006 Neel
7,557,755 B2 * 7/2009 Han ..... H01Q 1/38 343/700 MS
2017/0207546 A1 7/2017 Benzel et al.
2017/0256860 A1 9/2017 Liao
2018/0145420 A1 5/2018 Kushta

FOREIGN PATENT DOCUMENTS

GB 2508428 A 6/2014

OTHER PUBLICATIONS

Amruta S. Dixit and Sumit Kumar, "A Survey of Performance Enhancement Techniques of Antipodal Vivaldi Antenna", IEEE Access,vol. 8, p. 45774-45796, pub. Feb. 28, 2020 (current version Mar. 16, 2020).

* cited by examiner

*Primary Examiner* — Hasan Islam
(74) *Attorney, Agent, or Firm* — The Watson IP Group, PLC; Jovan N. Jovanovic

(57) ABSTRACT

A tapered slot antenna includes a cavity, first and second antenna flanges, a tapered slot, and first and second current wings. The first and second antenna flanges can be disposed on a first half and a second half of the tapered slot antenna, respectively. The second antenna flange can be electrically coupled to the first antenna flange, the first and second antenna flanges tapering from a greater flange width proximate to a top of the tapered slot antenna to a lesser flange width proximate to the cavity. The first current wing can be disposed on the first half of the antenna and the second current wing can be disposed on the second side of the antenna. The first and second sidewalls can be disposed on the first and second halves of the tapered slot antenna, respectively, can taper from the top to a bottom of the tapered slot antenna.

16 Claims, 5 Drawing Sheets

TAPERED SLOT ANTENNA

CROSS-REFERENCE TO RELATED APPLICATION

NA

BACKGROUND OF THE DISCLOSURE

1. Field of the Disclosure

The disclosure relates in general to an antenna, and more particularly, to a tapered slot antenna.

2. Background Art

Tapered slot antennas with broadband performance are typically large. Realizable gain is typically +6 dBi, with very few compact designs able to provide gain up to +10 dBi at narrow frequency ranges in their operational band. An example of a tapered slot antenna with a specific slot taper curvature is known as a Vivaldi antenna.

SUMMARY OF THE DISCLOSURE

The disclosure is directed to a tapered slot antenna that is comprised of a cavity, first and second antenna flanges, a tapered slot, and first and second current wings. The cavity can be disposed proximate to a bottom of the tapered slot antenna. The first antenna flange can be disposed on a first half of the tapered slot antenna, the first antenna flange tapering from a greater flange width proximate to a top of the tapered slot antenna to a lesser flange width proximate to the cavity. The second antenna flange can be disposed on a second half of the antenna and electrically coupled to the first antenna flange, the second antenna flange tapering from the greater flange width proximate to the top of the tapered slot antenna to a lesser flange width proximate to the cavity. The tapered slot can be disposed approximately equidistant between the first and second antenna flanges and extends from the cavity to the top of the tapered slot antenna. The first current wing can be disposed on the first half of the antenna and can be electrically coupled to the first and second antenna flanges, a first flange gap being disposed between the first antenna flange and the first current wing. The second current wing can be disposed on the second half of the antenna, the second current wing can be electrically coupled to the first current wing and the first and second antenna flanges, a second flange gap can be disposed between the second antenna flange and the second current wing. The first and second sidewalls can be disposed on the first and second halves of the tapered slot antenna, respectively, and can taper from a greater antenna width proximate to the top of the tapered slot antenna to a lesser antenna width proximate to the bottom of the tapered slot antenna.

In some configurations, the tapered slot antenna can further comprise a dielectric substrate, the first and second antenna flanges and the first and second current wings being disposed on the dielectric substrate.

In some configurations, the dielectric substrate can be a Printed Circuit Board (PCB), the first and second antenna flanges and the first and second current wings being a conductive material formed on the PCB.

In some configurations, the conductive material can be at least one of copper, silver, aluminum, nickel, gold, an alloy of at least one of the copper, the silver, the aluminum, the nickel, the gold, and a solder of at least one of the copper, the silver, the aluminum, the nickel, and the gold.

In some configurations, the cavity can be circular in shape.

In some configurations, the tapered slot antenna can further comprise an input connector region disposed on the bottom of the tapered slot antenna.

In some configurations, the tapered slot antenna can further comprise a Radio Frequency (RF) connector that is capacitively coupled to the conductive material surrounding the input connector region.

In some configurations, the tapered slot antenna can further comprise a broadband stepped quarter-wave impedance transformer and a feed line on a back-side of the tapered slot antenna, the broadband stepped quarter-wave impedance transformer being disposed in the feed line between the input connector region and a slot launch region of the tapered slot antenna.

In some configurations, the tapered slot antenna can further comprise a radial stub disposed on the back-side of the tapered slot antenna, the radial stub being capacitively coupled to the conductive material on a front-side of the tapered slot antenna.

In some configurations, the tapered slot antenna can operate across Global Navigation Satellite System (GNSS) frequencies, global cellular bands, and Unlicensed National Information Infrastructure (UNIT) bands.

In some configurations, the tapered slot antenna can further comprise an auxiliary director disposed proximate to the top of the tapered slot antenna and along a centerline extending from the top to the bottom of the tapered slot antenna.

In some configurations, the auxiliary director can include a plurality of directing elements that are equidistant from each successive neighboring directing elements.

In some configurations, the tapered slot antenna can further comprise a dielectric substrate tab that extends beyond a main body of the tapered slot antenna, with at least one of the plurality of directing elements being disposed on the dielectric substrate tab.

In some configurations, the tapered slot antenna can further comprise a connector notch disposed on the bottom of the tapered slot antenna.

In some configurations, the tapered slot antenna can further comprise a load element disposed on the back-side of the tapered slot antenna to provide dielectric slot loading on a region including a feed line.

In some configurations, the tapered slot antenna can further comprise rounded flare points disposed on ends of the first and second antenna flanges, respectively, and proximate to the top of the tapered slot antenna.

BRIEF DESCRIPTION OF THE DRAWINGS

The disclosure will now be described with reference to the drawings wherein.

DETAILED DESCRIPTION OF THE DISCLOSURE

Figure 1:
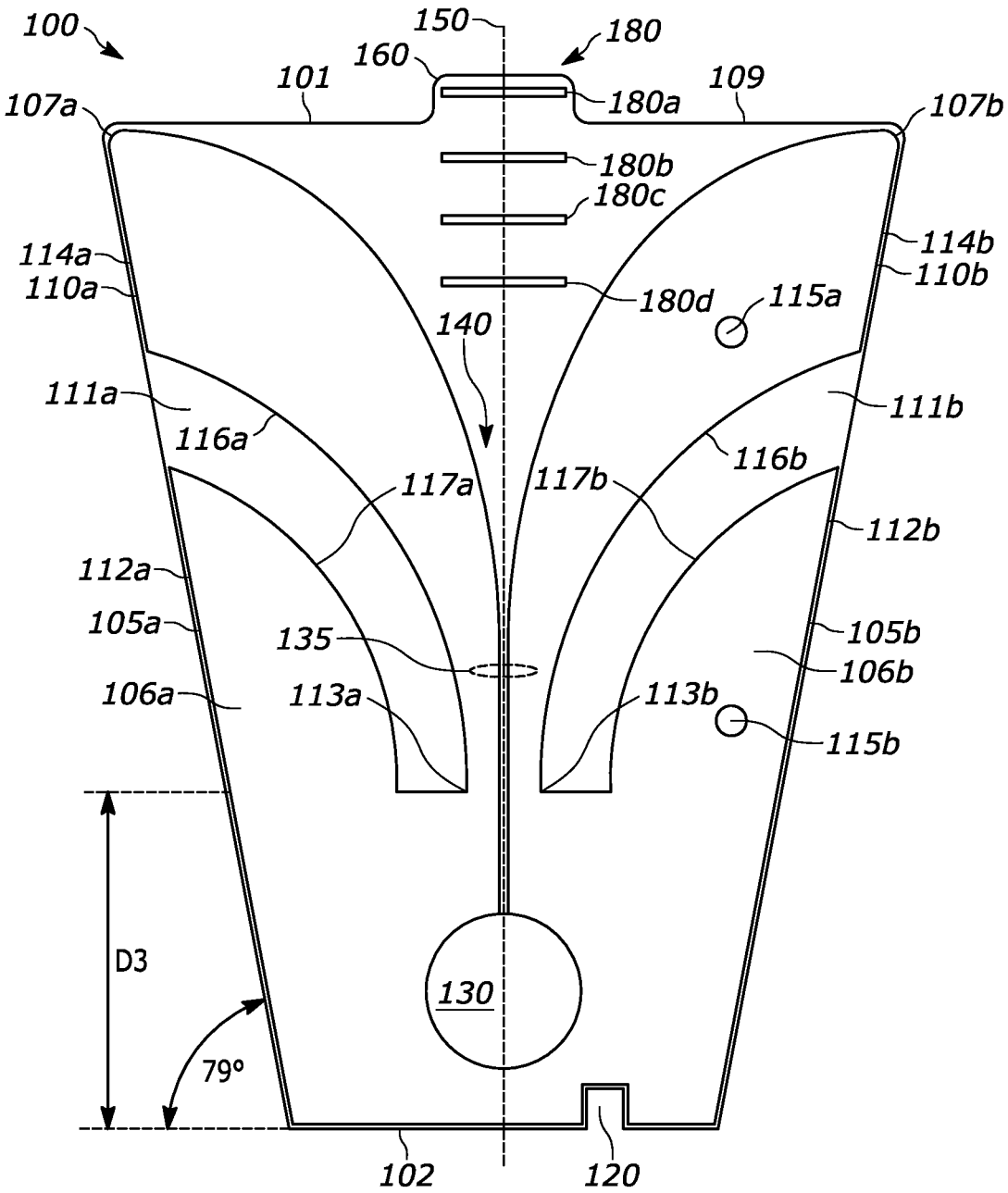
FIG. 1 illustrates an example front-side view of a tapered slot antenna, in accordance with at least one embodiment disclosed herein.

While this disclosure is susceptible of embodiment(s) in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

There is a need for a tapered slot antenna that works well at frequencies that specifically include commercial bands such as 5.8 GHz, 5.2 GHz, 2.4 GHz, and video and other data bands at lower frequencies. These frequencies utilize a broad bandwidth with high gain for point to multi-point or mobile point to point applications. For mobile systems, achieving high gain across many bands in a compact form factor is a challenge. In accordance with at least one embodiment, a tapered slot antenna is disclosed that can operate at a high realized antenna gain value and industry-acceptable input reflection across desirable frequency bands, within a compact form factor (e.g., approximately 3.61 cm at its widest width, approximately 1.893 cm at its narrowest width, and approximately 4.63 cm in height).

At least one embodiment of the tapered slot antenna can operate across commonly used Global Navigation Satellite System (GNSS) frequencies for all presently deployed systems as well as numerous global cellular (e.g., Universal Mobile Telecommunications System (UMTS)/3G/4G) bands, dedicated video bands, and the most commonly used unlicensed and Unlicensed National Information Infrastructure (UNIT) bands used by nearly every consumer Radio Frequency (RF) communications device. Such performance can be achieved through one or more of a design(s) of the slot radiating element itself, control of return currents in field regions of the tapered slot antenna, capacitive coupling of a broadband feed and connector, and auxiliary directors providing additional performance for several critical bands. In at least one embodiment, each of these elements can be operated together in an integrated fashion to achieve radiating characteristics desired.

Referring now to the drawings and in particular to FIG. 1, at least one embodiment is disclosed that includes a tapered slot antenna, such as a Tapered Slot Antenna (TSA) 100, a front-side view of which is illustrated as including a first antenna flange 110*a*, a second antenna flange 110*b*, a first current wing 106*a*, a second current wing 106*b*, a cavity 130, and a first slot, such as a tapered slot 140. The first antenna flange 110*a* and the second antenna flange 110*b* are separated by the tapered slot 140. The tapered slot 140 is disposed approximately equidistant from first and second edges 112*a*/112*b* of the TSA 100 and equidistant between the first antenna flange 110*a* and the second antenna flange 110*b*, in the orientation shown in FIG. 1 the first edge 112*a* corresponding to the left half of the TSA 100 and the second edge 112*b* corresponding to the right half of the TSA 100. The TSA 100 is approximately symmetrical about a center line 150 of the TSA 100, the center line 150 extending from the top 101 to a bottom 102 of the TSA 100. The tapered slot 140 extends from the cavity 130 and exponentially widens from the cavity 130 that is disposed proximate to the bottom 102 of the TSA 100 to a top 101 of the TSA 100. The cavity 130 is surrounded by an electrically conductive material that extends from the bottom 102 to the first and second edges 112*a*/112*b* and that also forms the first and second antenna flanges 110*a*/110*b* and the first and second current wings 106*a*/106*b*. Radio waves emanate from the TSA 100 at a slot launch region 135 along the tapered slot 140, approximately half a distance from the bottom 102 of the TSA 100 to the top 101 of the TSA 100.

In at least one embodiment, the cavity 130 is circular. However, the cavity 130 can be other shapes including square, rectangular, pentagonal, hexagonal, ovoid, or any other shape to push electrical currents toward the first and second edges 112*a*/112*b* of the TSA 100. In at least one embodiment, sidewalls 105*a*/105*b* of the TSA 100 disposed on the first and second edges 112*a*/112*b* (left and right edges in the orientation shown in FIG. 1) can have an overall taper from the top 101 of the TSA 100 to the bottom 102 of the TSA 100, tapering from a greater antenna width proximate to the top 100 to a lesser antenna width proximate to the bottom 102. In at least one embodiment, the greater antenna width is a widest portion of the TSA 100 and the lesser antenna width is the narrowest portion of the TSA 100. In at least one embodiment, this taper results in an angle between the first edge 112*a* and the bottom 102 of approximately 79 degrees relative to the bottom 102, with a like negative equal angle being formed between the second edge 112*b* and the bottom 102 for symmetry. In at least one other embodiment, the angle formed by the taper can be more or less than 79 degrees without departing from the scope of the embodiment(s) disclosed.

On either side of the tapered slot 140 is disposed the first antenna flange 110*a* and the second antenna flange 110*b*. The first and second antenna flanges 110*a*/110*b* curve from a point approximately a third of distance D3 between the bottom 102 and the top 101 of the TSA 100, and proximate to the cavity 130. The first and second antenna flanges 110*a*/110*b* taper from narrowest element portions 113*a*/113*b*, respectively, proximate to the cavity 130, to widest element portions 114*a*/114*b*, respectively, proximate to the top 101 of the TSA 100. In at least one embodiment, the first and second antenna flanges 110*a*/110*b* form flat edges at their widest element portions 114*a*/114*b*, respectively.

In at least one embodiment, the TSA 100 can further include rounded flare points 107*a*/107*b* that are disposed on ends of the first and second antenna flanges 110*a*/110*b*, respectively, and are proximate to the top 100 of the TSA 100, as shown. The rounded flare points 107*a*/107*b* reduce an effective impedance of nearfield air at lowest radiating frequencies, with no currents actually flowing in the rounded flare points 107. Depending upon a configuration of the rounded flare points 107*a*/107*b*, the rounded flare points 107*a*/107*b* provide approximately 0.5 dB of free effective gain at a lowest band while slightly reducing a size and weight of the TSA 100. Furthermore, the rounded flare points 107*a*/107*b* can eliminate a need to break corners to reduce injury risk as acute angles in PCBs that can injure assembly personnel or users if exposed in an assembly.

First and second flange gaps 111*a*/111*b* are disposed along first and second bottom edges 116*a*/116*b*, respectively, of the first and second antenna flanges 110*a*/110*b*, respectively. The first and second flange gaps 111*a*/111*b* are curved in shape, beginning at the narrowest portions 113*a*/113*b*, respectively, of the first and second antenna flanges 110*a*/110*b*, respectively. The first and second flange gaps 111*a*/111*b* end approximately two-thirds distance to the top 101 of the TSA 100 from the bottom of the TSA 100, along the first and second edges 112*a*/112*b*, respectively, of the TSA 100. In the embodiment shown, the first and second flange gaps 111*a*/111*b* slowly increase in width from the narrowest element portions 113*a*/113*b* of the first and second antenna flanges 110*a*/110*b* proximate to the cavity 130, respectively, to portions proximate to the first and second edges 112*a*/112*b*, respectively, of the TSA 100. In the embodiment shown, the narrowest opening width of the first and second flange gaps 111*a*/111*b* are approximately half as wide (approximately ⅔) as the widest portion of the first and second flange gaps 111*a*/111*b*, although wider and narrower widths can be used without departing from the scope of the embodiment(s) disclosed. In the embodiment shown, the narrowest portions of the first and second flange gaps 111*a*/111*b* form straight edges that run parallel to the bottom 102 of the TSA 100, thereby forming a boxed end at the narrowest element portions 113*a*/113*b*, although other shapes, angles, and curvatures are possible.

The TSA 100 further includes first and second current wings 106*a*/106*b* disposed on the first and second edges 112*a*/112*b* of the TSA 100, for improved lower-frequency band performance. The first and second current wings 106*a*/106*b* are disposed along first and second bottom edges 117*a*/117*b*, respectively, of the first and second flange gaps 111*a*/111*b*, respectively. The first and second current wings 106*a*/106*b* are electrically coupled to each other and to the first and second antenna flanges 110*a*/110*b*. The first and second current wings 106*a*/106*b* are curved in shape to correspond to the bottom edges 117*a*/117*b*, respectively, of the first and second flange gaps 111*a*/111*b*, respectively. The first and second current wings 106*a*/106*b* are wing shaped with a tip of the "wings" being disposed where the first and second flange gaps 111*a*/111*b* end along the first and second edges 112*a*/112*b*, respectively, of the TSA 100. In the embodiment shown, there is a continuous conductor, e.g., metal, between the beginning of the first and second flange gaps 111*a*/111*b* and the first and second edges 112*a*/112*b*, respectively, of the TSA 100.

The first and second current wings 106*a*/106*b* and the tapered sidewalls 105*a*/105*b* work together to solve two parts of a problem for field current control. The resulting field regions produced by the first and second current wings 106*a*/106*b* and the tapered sidewalls 105*a*/105*b* do not have enough unobstructed area to set up "dipole-like" transmissions at broadband lower frequencies or to permit energy at higher frequencies to just dissipate looping around doing nothing constructive. Dipole mode suppression can be seen in two low-frequency dipole modes high-Q-factor modes at 880 and 1025 MHz in the input reflection FIGS. 7 and 8 discussed below. Moreover, as discussed below with respect to FIGS. 7 and 8, typical antennas lack performance because of the suppression effect of reducing the field region through tapering and slotting, as disclosed herein.

In at least one embodiment, the TSA 100 can further include at least one auxiliary director 108. In at least one embodiment, the auxiliary director 108 includes a plurality of auxiliary directing elements, such as four (4) auxiliary directing elements 108*a*/108*b*/108*c*/108*d*, that are equidistant from each successive neighboring auxiliary directing elements 108*a*/108*b*/108*c*/108*d*, and disposed along the center line 150 proximate to the top 101 of the TSA 100. In at least one other embodiment, the auxiliary director 108 can include more or less antenna flanges, as needed to achieve particular transmission and reception characteristics for the TSA 100. In at least one embodiment, at least one of the auxiliary directing elements 108*a*/108*b*/108*c*/108*d* can extend into a dielectric substrate tab 160 that extends beyond a main body of the TSA 100, as shown. In at least one embodiment, the auxiliary directing element 108*a* can be disposed on this dielectric substrate tab 160. The dielectric substrate tab 160 allows use of less material for a dielectric substrate 109 while simultaneously extending the auxiliary director 108 further away from the first and second antenna flanges 110*a*/110*b*. The auxiliary director 108 improves high-frequency realized antenna gain and reduce impedance for increased transmission efficiency at lower frequencies. Depending upon a configuration of the auxiliary director 108, an additional +2 dB at 5.2 and 5.8 GHz bands can be achieved by the auxiliary director 108.

In at least one embodiment, the TSA 100 further includes the dielectric substrate 109. The first and second antenna flanges 110*a*/110*b* and the first and second current wings 106*a*/106*b* can be disposed on the dielectric substrate 109. In at least one embodiment, the dielectric substrate 109 can be 30-mil thick Rogers 4350B material with Lo-Pro (reduced surface roughness) coating and 0.5 oz foil cladding both sides. This material has a design-in dielectric constant of approximately 3.67 at the frequencies described herein. However, a wide variety of printed circuit board materials can be used for the dielectric substrate 109 without departing from the scope of the embodiment(s) disclosed herein, including, but not limited to, FR-4 and its numerous variants from many vendors, higher-quality esoteric materials such as Rogers RT/duroid 5880, other low-dielectric materials specifically designed for antenna fabrication, and many others used across the RF and wireless electronics industry. Thus, the TSA 100 can be readily manufacturable in high-volume printed circuit card processes and materials. In at least one embodiment, the TSA 100 can utilize only two metal layers, such as a first side and a second side of a PCB dielectric, and with no vias. This configuration for the TSA 100 provides for a very low-cost antenna design that can readily be scaled to high-volume manufacturing by numerous domestic and overseas PCB fabrication service providers. In at least one embodiment, the electrically conductive layers can be formed from at least one of copper, silver, aluminum, nickel, gold, their alloys, and their solders, or any other electrically conductive material from which antennas can be formed.

In at least one embodiment, the TSA 100 can include one or more mounting holes, such as mounting holes 115*a*/115*b*. In the example shown, the mounting hole 115*a* is illustrated as being a via through the second antenna flange 110*b* and the dielectric substrate 109 thereunder, and the mounting hole 115*b* is illustrated as being a via through the second current wing 106*b* and the dielectric substrate 109 thereunder. Although two (2) mounting holes 115*a*/115*b* are illustrated, the number of mounting holes through the TSA 100 can be more or less, dependent upon a particular mounting configuration of the TSA 100. Likewise, the location of the mounting hole(s) 115 can vary from that illustrated, without departing from the embodiment(s) shown. Moreover, in at least one other embodiment other mounting configuration can be used with the TSA 100, such as one or more mounting brackets (not shown) attached to the TSA 100.

Figure 2:
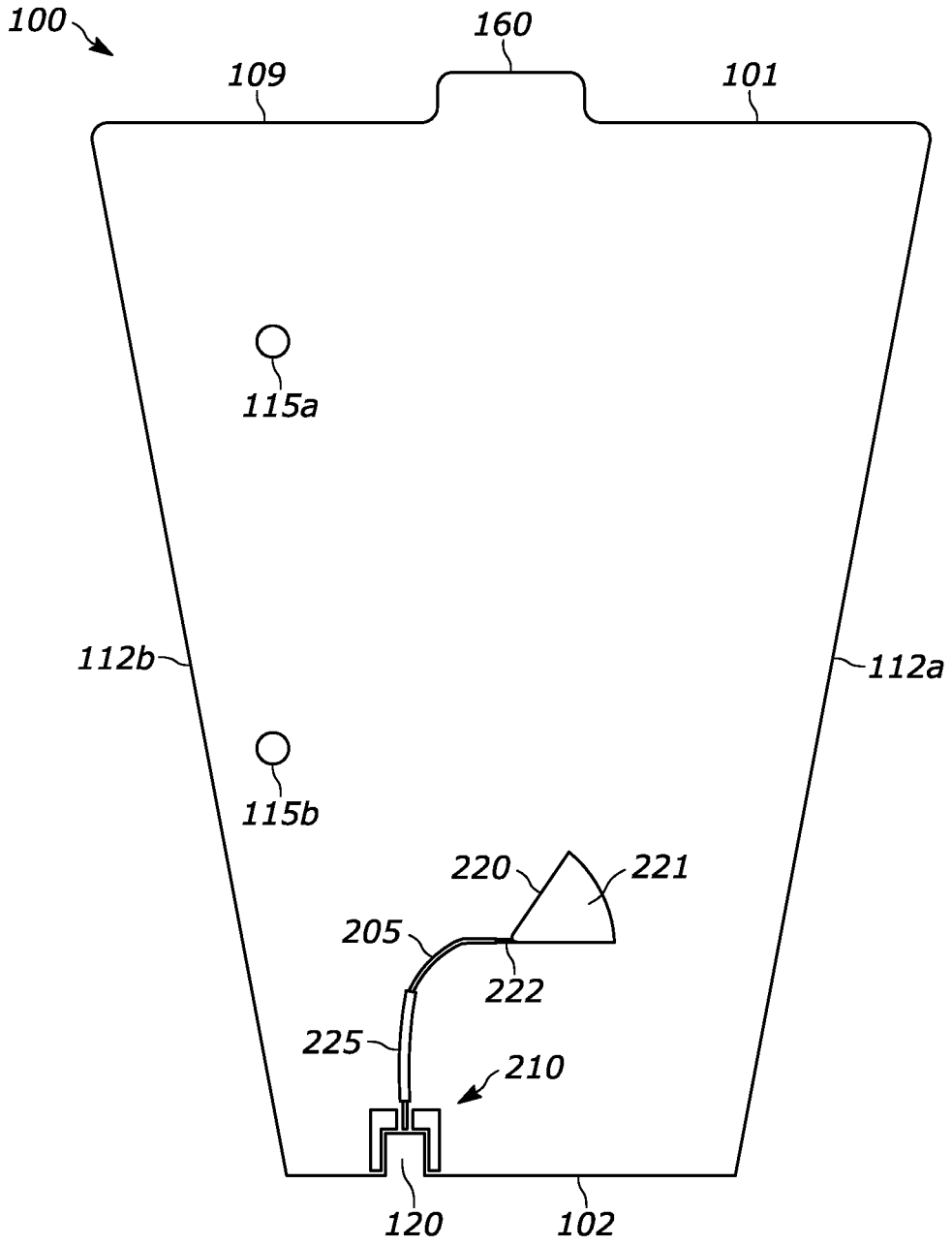
FIG. 2 illustrate an example back-side view of the tapered slot antenna shown in FIG. 1, in accordance with at least one embodiment disclosed herein.

With reference to FIG. 2, a back-side view of the TSA 100 is shown. Viewed from the back-side of the TSA 100, the TSA 100 can further include an input connector region 210, a feed line 205 (e.g., a 50 Ohm microstrip feed line), and a stub, such as a radial stub 220. The feed line 205 electrically couples the input connector region 210 with the radial stub 220. The input connector region 210 is coupled to the slot launch region 135 via the feed line 205. In this example, the feed line 205 is disposed perpendicular to the input connector region 210, as shown. Thereafter, the feed line 205 includes a straight portion after which the feed line 205 curves, in this example to the right for a short length after which the feed line 205 is coupled to the radial stub 220.

The radial stub 220 is capacitively coupled to conductive material on the front-side of the TSA 100, that is to the slot feed reference area of the electrically conductive material, in at least one embodiment, between the cavity 130 and the first radial slot 111*a*, shown in FIG. 1, on an opposite side of the TSA 100 from the radial stub 220. In this example, the radial stub 220 is pie wedge shaped, including a curved end 221 and a pointed tip end 222. The tip end 222 of the radial stub 220 is coupled to the feed line 205 and the curved end 221 is proximate to the slot feed. In at least one embodiment, the pie wedge shaped radial stub 220 is approximately 45 degrees of a circle, although larger and smaller radial stubs are possible without departing from the scope of the embodiment(s). Although a pie wedge shaped radial stub 220 is shown, other shapes are possible without departing from the scope of one or more embodiment(s) disclosed herein. In at least one embodiment, the radial stub 220 on the slot feed is centered on 5.2 GHz to maximize energy transfer from the microstrip to the tapered slot 140 at upper frequencies. Radial stubs, such as the radial stub 220, have a wide bandwidth of operational benefit. To help compensate at 2.4 GHz, a load element 410 (FIG. 4) can be sized to specifically aid 2.4 GHz energy transfer.

In at least one embodiment, the input connector region 210 can be a capacitively coupled input connector, capacitively coupled to conductive material surrounding the input connector region 210. Such a capacitively coupled input connector provides filtering in that it operates as a high-pass filter for return currents from the first and second antenna flanges 110*a*/110*b* and the first and second current wings 106*a*/106*b* back to a grounded shield (not shown) of a coaxial cable feed (not shown), bandwidth, and input reflection. The input connector region 210 can include one or more pads, such as pads 211*a* and 211*b*. As shown, the pads 211*a* and 211*b* can be disposed on opposite sides of the feed line 205 proximate to where the feed line 205 ends at the connector notch 120, opposite an end of the feed line 205 that is coupled to the radial stub 220. In at least one embodiment, the pads 211*a*/211*b* are each "L" shaped to simultaneously surround both the feed line 205 and the connector notch 120. A size of the pads 211*a*/211*b* of such the input connector region 210 and characteristics of a dielectric substrate can be selected according to those skilled in the art. In at least one other embodiment, the input connector region 210 can be a different type of connector, such as a pad that has a fixed or tight tolerance capacitor (not shown) on each pad over to a different pad that includes vias (not shown) to the slot launch region 135, or with a separate type of lower surface pad (not shown) that first makes an Ohmic connection and subsequently makes a capacitive connection. In at least one embodiment, the pads 211*a*/211*b* can be L-shaped pads with outer dimensions 275×120 mils, and having a cut-out of 175×70 mils. Each of the pads 2111/211*b* can have a calculated surface area of 20,750 square mils (about 26.8 square mm).

Given a pad size area A for pads 211*a*/211*b*, substrate thickness d, and dielectric constant $\varepsilon_r$, the return capacitive coupling C can be estimated using typical parallel-plate capacitor equations by those familiar with basic electrical engineering principals.

$$C = \frac{\varepsilon_r \varepsilon_0 A}{d}$$

A calculation using such an equation for the example dimensions listed above estimates return currents to be capacitively coupled with 1.2 pF. This small value of capacitance is known to be a significant impediment to currents at lower RF frequencies (<1 GHz), but considered to have low impedance at higher RF frequencies (>5 GHz).

This capacitance is created by a parallel plate overlap of the surface-mount pads 211*a*/211*b* of an RF connector 310 (FIG. 3) to the field region of the TSA 100. It is recognized that in other implementations of the presently describe subject matter, other values of capacitance may be required and used for optimal matching of return currents in the frequency range most of interest for a given design. In other embodiment(s) of the presently described subject matter, such capacitive coupling can be provided by having an Ohmic contact to chip passive components spanning between the RF connector solder pads and other pads having Ohmic contact to the field region.

In at least one embodiment, the TSA 100 further includes a broadband stepped quarter-wave impedance transformer 210. The stepped quarter-wave impedance transformer 210 can be disposed within the feed line 205 between the input connector region 210 and the slot launch region 135. The input connector region 210 feeds the feed line 205 that travels across the field region towards the slot launch region 135. In at least one embodiment, the slot launch region 135 is approximately 175 Ohms impedance, although other impedances are possible. In at least one embodiment, the slot launch region 135 can incorporate the broadband radial stub 220 which allows for a via-less antenna, reducing manufacturing cost associated with the TSA 100. In at least one embodiment, the broadband stepped quarter-wave impedance transformer 210 is disposed along a path between the input connector region 210 and the slot launch region 135 to improve matching between 1.6 and 6 GHz (center frequency of transform is 3 GHz). In at least one embodiment, broadband stepped quarter-wave impedance transformer 210 is centered on 3.4 GHz, having a wide bandwidth that provides a good match between the 2.4 and 5.8 GHz bands. The benefit at 1.2 to 1.6 GHz can be minimal, but the overall length of the broadband stepped quarter-wave impedance transformer 210 is appropriately sized to assist impedance transformation at these lowest frequencies of interest.

Figure 3:
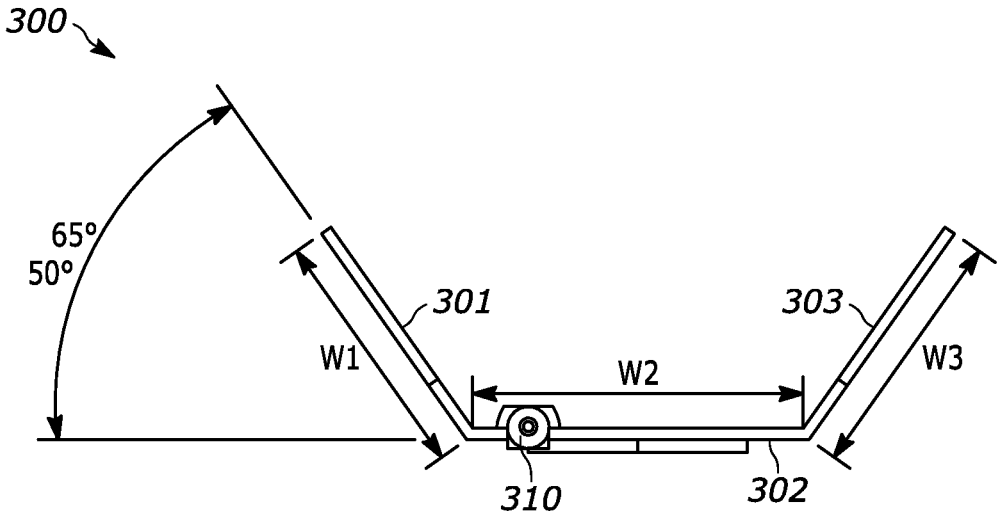
FIG. 3 illustrates a bottom view of another example tapered slot antenna, in accordance with at least one embodiment disclosed herein.

With reference to FIG. 3, a bottom view of another example TSA is shown, TSA 300. In this example, the TSA 300 includes three segments, a first segment 301, a second segment 302, and a third segment 303. In this example, the first, second, and third segments 301/302/303 are approximately equal in widths W1, W2, W3, respectively. In at least one embodiment, the TSA 200 can be cut into the first, second and third segments 301/302/303 and coupled (e.g., the dielectric substrate 109 can be glued and the conductive components can be soldered) to form the TSA 300. In at least one other embodiment, the first, second, and third segments 301/302/303 are defined by a scoring line and the TSA is bent into shape and secured with epoxy resin. In at least one embodiment, the angle between the first segment 301 and the second segment 302 can be between approximately (+−10%) 50 and 60 degrees, as shown. Such angles minimize the overall width of the TSA 300 as compared to the straight TSA 100 shown in FIG. 1, without substantially impacting the efficiency of transmission and reception over the majority of operating frequencies. Such a shape for the TSA 300 also is conducive to mounting the TSA 300 within a cylindrical, ovoid, faceted housing, or radome. Depending upon configuration needs for the TSA 300, the TSA 300 can be formed with angles greater than and less than those shown in the example TSA 300.

In at least one embodiment, the TSA 300 can further include the RF connector 310. In at least one embodiment, the RF connector 310 can be disposed at any convenient location on the TSA 200, such as at the connector notch 120 as shown in FIG. 1. In at least one embodiment, the RF connector 310 is a Sub-Miniature Push-on (SMP) edge-mount connector with a detent for RF cable retention, such as the SMP-MSFD-PCE-1 from Amphenol. In at least one other embodiment, at least one of a variety of similar RF connectors can be used from a wide variety of subminiature, miniature, or standard size RF connection lines including, but not limited to, SMA, MMCX, SMPM, and others known and used by those skilled in the art of RF electronics design and/or testing. In at least one embodiment, a directly soldered cable end (e.g., "pigtail" to those skilled in the art) can similarly be used to save on component cost at the expense of increased assembly labor.

Figure 4:
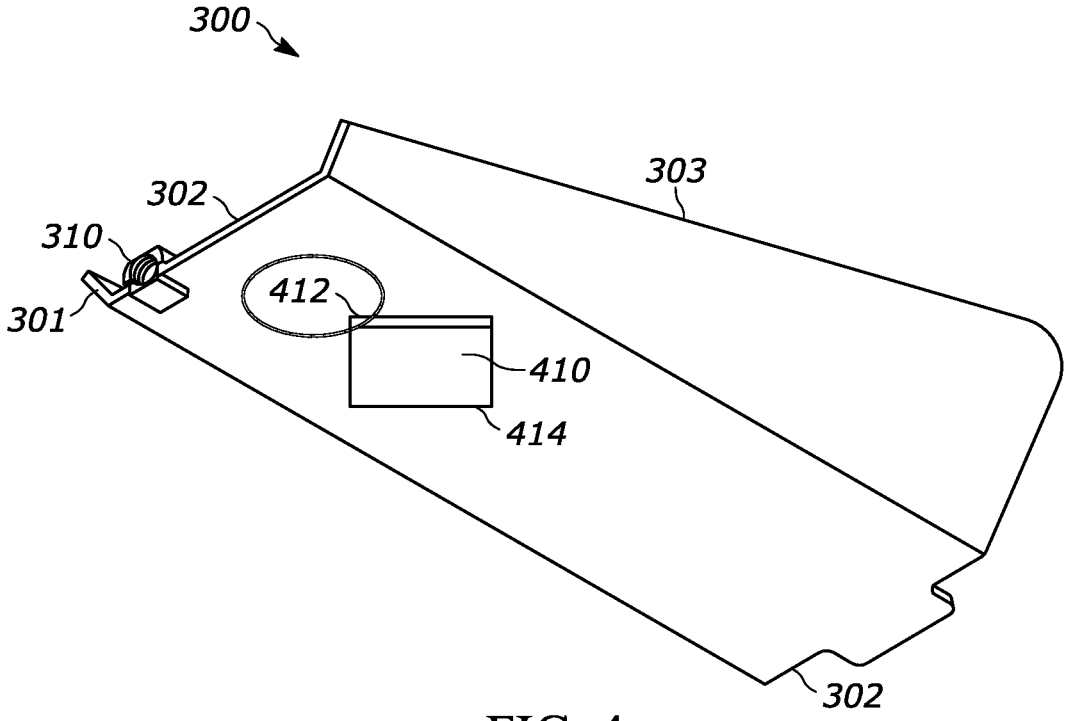
FIG. 4 illustrates an isometric back-side view of the tapered slot antenna shown in FIG. 3, in accordance with at least one embodiment disclosed herein.
Figure 5:
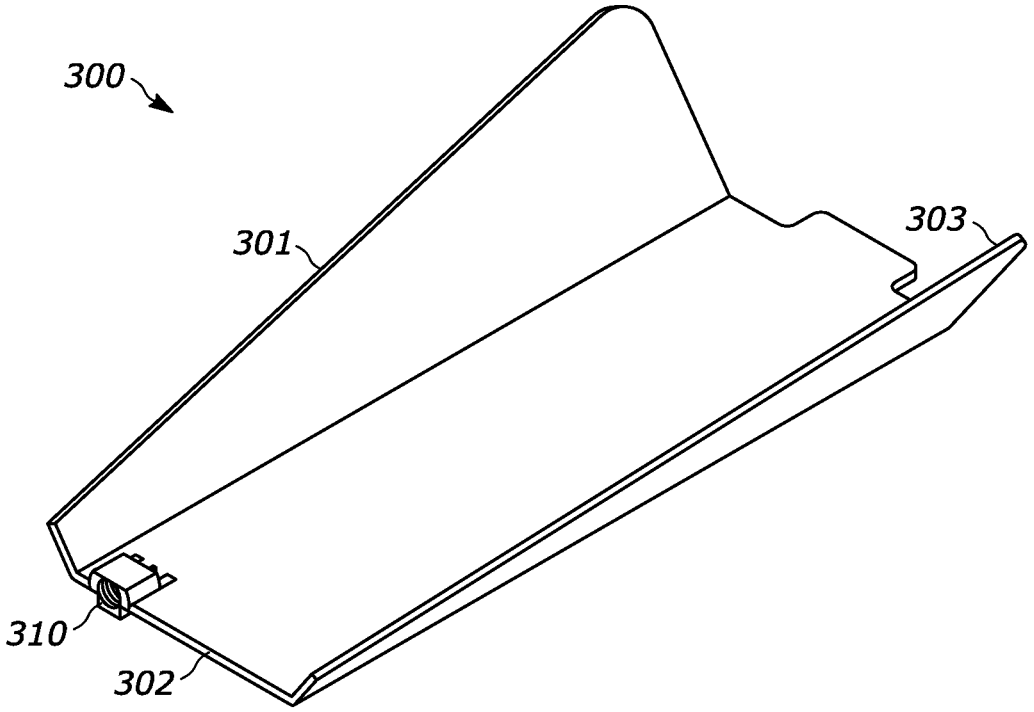
FIG. 5 illustrates an isometric front-side view of the tapered slot antenna shown in FIG. 3, in accordance with at least one embodiment disclosed herein.

With reference to FIG. 4, an isometric back-side view of the TSA 300 shown in FIG. 3 is shown as further including, in at least one embodiment, the load element 410 disposed on the back-side of the TSA 300. FIG. 5 shows an isometric back-side view of the TSA 300. In this example, the load element 400 is approximately a square element, disposed with a first corner 412 slightly overlapping the cavity 130 (which is disposed on a front-side of the TSA 300), disposed on the back-side of the TSA 300 and pointing towards a bottom of the TSA 300, and an opposite second corner 414 pointing towards a top 301 of the TSA 300. The load element 410 provides dielectric slot loading on a region including the feed line 205, as shown in FIG. 2. The load element 410 improves broadband transfer of energy from the feed line 205 to the traveling slot towards the radial stub 220, increasing total efficiency of this energy transfer.

In at least one embodiment, the load element 410 can be a 50-mil thick Rogers RO3006 with no cladding. This material has a design-in dielectric constant of approximately 6.5 at the frequencies described herein. However, a wide variety of printed circuit board and ceramic materials can be used for the load element 410 without departing from the scope of the features disclosed herein, including, but not limited to, FR-4 and its numerous variants from many vendors, esoteric materials such as Rogers RO4360G2, alumina, mica, and other dielectric materials used in the microwave components and circuits industry.

In at least one embodiment, the load element 410 is a square 0.625" on each side. Such a square shape minimizes fabrication cost and material waste, as RO3006 is readily cut with shears, blades, and industrial cutting equipment. In other implementations of the presently described embodiment(s), other sizes of squares, rectangles, circles, ovals, and other polygons can be preferred for RF slot loading. Curved surfaces near the output region of the slot, for example, are typically preferred over the right angle corner of the example rotated square, as circles present a uniform engagement for interacting with electromagnetic waves, and circles are intrinsically tolerant to assembly tolerance (e.g., sin(θ) alignment error, where θ is small).

Figure 6:
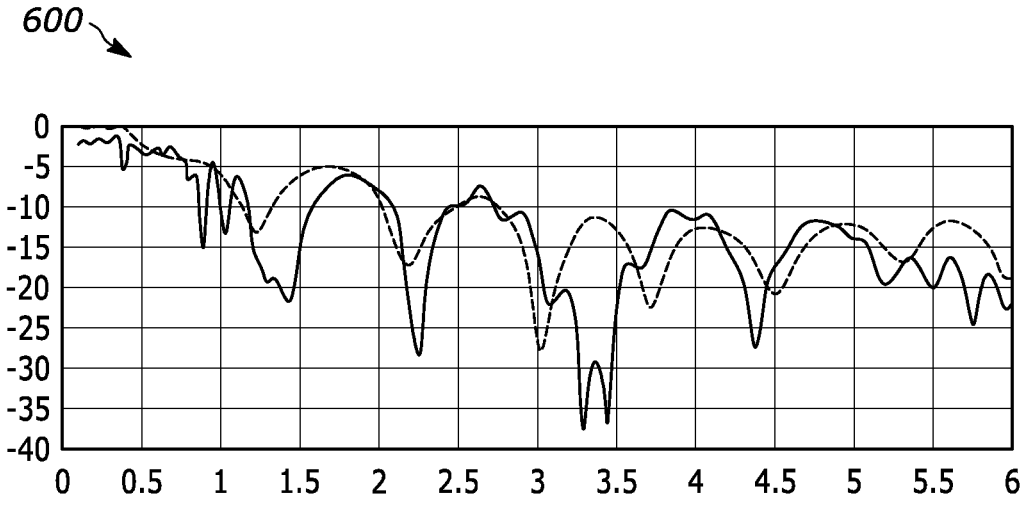
FIG. 6 illustrates an input reflection graph for the tapered slot antennas shown in FIGS. 1 and 2, in accordance with at least one embodiment disclosed herein, compared to a larger conventional slot antenna of similar bandwidth.

FIG. 6 illustrates an input reflection graph 600 for the TSA 100 of the presently disclosed subject matter (solid line) as well as data for a modern commercially available Vivaldi antenna from a highly-regarded vendor designed in a typical manner without use of the presently disclosed feature(s). The x-axis shows frequency in GHz, and the y-axis shows input reflection (scattering parameter S 11 or equivalent) in dB. As known to those skilled in the art of antenna design, the operable bandwidth (or multiple separate bands) of an antenna is typically defined as where such an antenna has an input reflection less than (more negative than) −10 dB. It is further recognized that antennas still radiate at higher values of input reflection, but efficiency and realized gain typically suffer.

According to the input reflection of the solid line shown in FIG. 6, there are three preferred operating bands supported by the example TSA 100 incorporating the presently disclosed feature(s). A lower band between 1.15 and 1.6 GHz, a moderate band between 2.1 and 2.5 GHz, and a higher band between 2.75 and 6 GHz is shown (and likely higher than 6 GHz, as evident to those skilled in the art of antenna design and measurement). These bands represent a desirable 4.1 GHz subset of the sub-6 GHz commercial bands. The illustrated reflection is for the TSA 100 having example dimensions of 4.355 inches long and 3.50 inches at its widest point, taking up approximately 13 square inches of PCB material and mounting area and weighs approximately 18 grams.

According to the input reflection of the dashed line in FIG. 6, there are also three preferred operating bands supported by the typical Vivaldi antenna without incorporating the presently disclosed feature(s). A lower band between 1.1 and 1.3 GHz, a moderate band between 2.0 and 2.45 GHz, and a higher band between 2.75 and 6 GHz (and beyond) is shown. This antenna performs sub-optimally in the GPS L1, 2.4 GHz ISM, and numerous UMTS cellular bands of operation, covering a partially desirable 3.9 GHz subset of the sub-6 GHz commercial bands. The illustrated reflection is for a typical antenna that is 5.9 inches long and 4.9 inches at its widest point, taking up approximately 26 square inches of PCB material and mounting area and weighing approximately 60 grams.

Considering the above data comparison, it is seen that the presently described example TSA 100 outperform the high-quality commercially available typical antenna at all desirable commercial frequencies below 6 GHz, with the TSA 100 doing so in half the size and one third of the weight.

Figure 7:
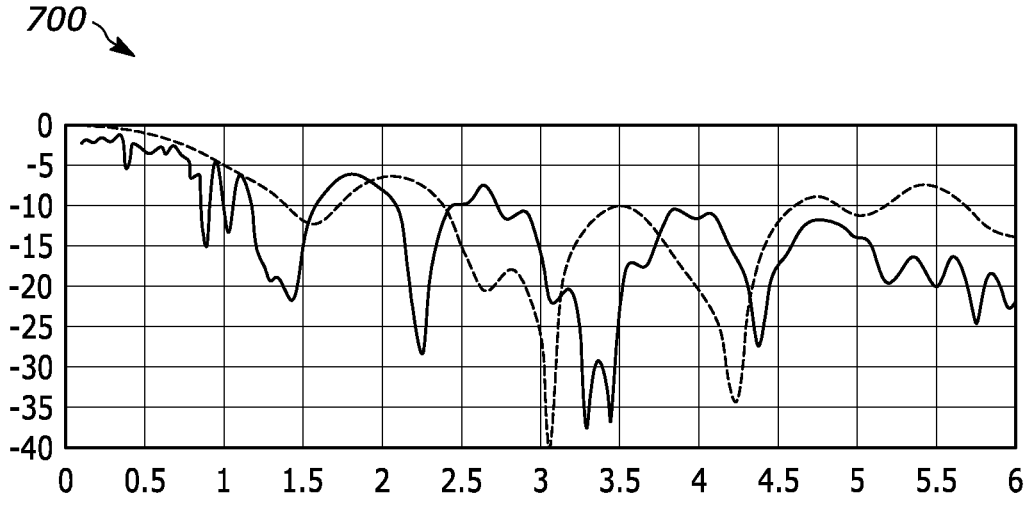
FIG. 7 illustrates the same input reflection graph for the tapered slot antennas shown in FIGS. 1 and 2, in accordance with at least one embodiment disclosed herein, compared to a conventional slot antenna of similar size.

A separate comparison can be made regarding substantially higher performance than typical slot antennas given a similar size and weight. FIG. 7 shows another input reflection graph 700 of the same implementation of the presently disclosed feature(s) (solid line) of the TSA 100 as well as the data for a custom typical Vivaldi antenna (dashed line) from a second highly-regarded vendor designed in a typical manner without use of the presently disclosed features.

From reflection of the dashed line in FIG. 7, there are three preferred operating bands supported by the second typically-designed Vivaldi antenna. A lower band between 1.45 and 1.7 GHz, a moderate band between 2.4 and 4.45 GHz, and a higher band between 5.7 and 6 GHz (and beyond) is shown. As with the previously measured typical antenna, performance in numerous licensed and unlicensed commercial bands of operation is sub-optimal, covering only 2.6 GHz out of the sub-6 GHz commercial bands. This typical antenna is 4.4 inches long and 3.6 inches at its widest point, taking up approximately 16 square inches of PCB material and mounting area, and weighing approximately 30 grams.

Considering the above data comparison, it is seen that the presently described example TSA 100 significantly outperforms typically-designed slot antennas at desirable commercial frequencies below 6 GHz of comparable overall dimensions while still taking up less size and weight.

It is contemplated that slot antennas that employ the presently described feature(s) are particularly attractive for antenna arrays owing to their compact size and superior bandwidth. These advantages are valuable for arrays consisting of substantially similar slot antennas as well as for arrays consisting of a variety of antennas and bandwidths in proximity. Antennas in close proximity are known to couple to each other, changing the input and radiating characteristics of one or both antennas dependent on their type, structure, and proximity. Electrically smaller antennas (smaller as compared to their wavelength of operation) are known to interact less with adjacent antennas. Broadband antennas are more tolerant of interaction, as de-tuning (frequency shifting of resonance and/or operating frequency range) can be accommodated due to the wide operating range.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A tapered slot antenna, comprising:

a cavity disposed proximate to a bottom of the tapered slot antenna;

a first antenna flange disposed on a first half of the tapered slot antenna, the first antenna flange tapering from a greater flange width proximate to a top of the tapered slot antenna to a lesser flange width proximate to the cavity;

a second antenna flange disposed on a second half of the antenna and electrically coupled to the first antenna flange, the second antenna flange tapering from the greater flange width proximate to the top of the tapered slot antenna to the lesser flange width proximate to the cavity;

a tapered slot disposed approximately equidistant between the first and second antenna flanges, and extending from the cavity to the top of the tapered slot antenna;

a first current wing disposed on the first half of the antenna and electrically coupled to the first and second antenna flanges, a first flange gap being disposed between the first antenna flange and the first current wing; and a second current wing disposed on the second half of the antenna, the second current wing being electrically coupled to the first current wing and the first and second antenna flanges, a second flange gap being disposed between the second antenna flange and the second current wing;

wherein first and second sidewalls disposed on the first and second halves of the tapered slot antenna, respectively, taper from a greater antenna width proximate to the top of the tapered slot antenna to a lesser antenna width proximate to the bottom of the tapered slot antenna.

2. The tapered slot antenna according to claim 1, further comprising a dielectric substrate, the first and second antenna flanges and the first and second current wings being disposed on the dielectric substrate.

3. The tapered slot antenna according to claim 2, wherein the dielectric substrate is a Printed Circuit Board (PCB), the first and second antenna flanges and the first and second current wings being a conductive material formed on the PCB.

4. The tapered slot antenna according to claim 3, wherein the conductive material is at least one of copper, silver, aluminum, nickel, gold, an alloy of at least one of the copper, the silver, the aluminum, the nickel, the gold, and a solder of at least one of the copper, the silver, the aluminum, the nickel, and the gold.

5. The tapered slot antenna according to claim 1, wherein the cavity is circular in shape.

6. The tapered slot antenna according to claim 1, further comprising an input connector region disposed on the bottom of the tapered slot antenna.

7. The tapered slot antenna according to claim 6, further comprising a Radio Frequency (RF) connector that is capacitively coupled to a conductive material surrounding the input connector region.

8. The tapered slot antenna according to claim 6, further comprising a broadband stepped quarter-wave impedance transformer and a feed line on a back-side of the tapered slot antenna, the broadband stepped quarter-wave impedance transformer being disposed in the feed line between the input connector region and a slot launch region of the tapered slot antenna.

9. The tapered slot antenna according to claim 8, further comprising a radial stub disposed on the back-side of the tapered slot antenna, the radial stub being capacitively coupled to a conductive material on a front-side of the tapered slot antenna.

10. The tapered slot antenna according to claim 1, wherein the tapered slot antenna operates across Global Navigation Satellite System (GNSS) frequencies, global cellular bands, and Unlicensed National Information Infrastructure (UNIT) bands.

11. The tapered slot antenna according to claim 1, further comprising an auxiliary director disposed proximate to the top of the tapered slot antenna and along a centerline extending from the top to the bottom of the tapered slot antenna.

12. The tapered slot antenna according to claim 11, wherein the auxiliary director includes a plurality of auxiliary directing elements that are equidistant from each successive neighboring auxiliary directing elements.

13. The tapered slot antenna according to claim 12, further comprising a dielectric substrate tab that extends beyond a main body of the tapered slot antenna, with at least one of the first and second antenna flanges being disposed on the dielectric substrate tab.

14. The tapered slot antenna according to claim 1, further comprising a connector notch disposed on the bottom of the tapered slot antenna.

15. The tapered slot antenna according to claim 1, further comprising a load element disposed on a back-side of the tapered slot antenna to provide dielectric slot loading on a region including a feed line.

16. The tapered slot antenna according to claim 1, further comprising rounded flare points disposed on ends of the first and second antenna flanges, respectively, and proximate to the top of the tapered slot antenna.

* * * * *